US006948575B1

(12) United States Patent
Mosing et al.

(10) Patent No.: US 6,948,575 B1
(45) Date of Patent: Sep. 27, 2005

(54) SLIP MANIPULATING APPARATUS

(75) Inventors: Donald E. Mosing, Lafayette, LA (US); David L. Sipos, Youngsville, LA (US)

(73) Assignee: Frank"s Casing Crews and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 10/414,893

(22) Filed: Apr. 15, 2003

(51) Int. Cl.[7] ..... E21B 19/10; E21B 19/16

(52) U.S. Cl. ..... 175/423; 166/77.51; 166/85.5; 166/380

(58) Field of Search ..... 166/378, 380–382, 166/75.11, 77.1, 77.51, 77.53, 85.1, 85.5; 175/423

(56) References Cited

U.S. PATENT DOCUMENTS

RE23,842 E 6/1954 Moore
3,154,146 A * 10/1964 Brown ..... 166/313
3,457,605 A * 7/1969 Kingsbury et al. ..... 188/67
4,275,487 A * 6/1981 Gray et al. ..... 188/67
4,306,339 A 12/1981 Ward
4,354,706 A * 10/1982 Coyle, Sr. ..... 294/102.2
4,381,584 A * 5/1983 Coyle, Sr. ..... 188/67
4,489,794 A * 12/1984 Boyadjieff ..... 175/85
4,715,456 A * 12/1987 Poe et al. ..... 175/423
4,821,814 A * 4/1989 Willis et al. ..... 173/164
5,036,927 A * 8/1991 Willis ..... 175/162
5,042,601 A * 8/1991 Penisson ..... 175/423
5,123,484 A * 6/1992 Bode ..... 166/77.51
5,848,647 A * 12/1998 Webre et al. ..... 166/379
6,056,060 A * 5/2000 Abrahamsen et al. ..... 166/380
6,206,096 B1 * 3/2001 Belik ..... 166/77.51

* cited by examiner

*Primary Examiner*—David Bagnell
*Assistant Examiner*—Jennifer H Gay
(74) *Attorney, Agent, or Firm*—John D. Jeter

(57) ABSTRACT

The spider for large pipe has a base that straddles a slip bowl and supports an overarm that extends part way around pipe to be supported. The overarm is pivotally attached to the base and is moved vertically by an air bag or power cylinders to move a slip assembly into and out of the tapered bore of the slip bowl to releasably support a pipe string.

12 Claims, 6 Drawing Sheets

SLIP MANIPULATING APPARATUS

This invention pertains to hardware for supporting large diameter oil field tubulars suspended below a rig floor. Additionally, it pertains to lifting apparatus to be operated adjacent to suspended pipe to move slips that support the pipe. More particularly, but not in a limiting sense, it pertains to the equivalent of slip bowls and related slips and unique powered apparatus for manipulating the slips.

BACKGROUND

Large diameter casing and piling, being assembled and installed in a vertical orientation, may be handled by drilling rigs but are often handled by site preparation rigs having less capacity for lifting and for supporting rig floor loads.

Slip bowls designed to handle large diameter tubulars have been directed to short term use. For short term use, efficiency essential to drilling spiders, is rarely present. Large oil field tubulars may be six feet in diameter and a spider based on the usual drilling rig spider would be very large and heavy. Site preparation rigs would rarely be capable of handling such massive spiders. Such massive spiders would take up excessive rig floor space and alternatives are preferred.

Throughout the early rotary drilling history the slip set could be manually lifted out of the slip bowl of the rotary table and placed upon the nearby horizontal surface. For stability, at rest, the hingedly connected slip set is left slightly curved. When needed, one person can drag the slip set into the slip bowl to embrace the drill string, which it will then support when necessary.

The term spider applies to slip bowls, slips, and powered slip manipulation gear. The term apparently originated when larger pipe was run into wells and the rotary slip bowl could not be used. The large pipe adaptation sat on the rig floor above the rotary table.

More modern spiders in drilling service are fluid powered with the operating mechanism enclosed for safety. Efficient and safe handling of drilling-type slips have been achieved. For the slip bowls used on rather large oil field tubing, slip handling is beyond the capacity of human lifting and rig service hoisting gear is used. The individual slip elements are much like the drilling related slips but the large pipe periphery calls for slips made up into chains that may contain over thirty slips. When rig supplied hoists are used to lift slips, the slip chain becomes unruly once clear of the confining slip bowl. Some man-handling of the slip chain is necessary. That activity is hazardous and it is always relatively slow. Cost and danger supplies incentive to better manage the slips used on large tubulars.

A spider normally includes a slip bowl and the slip operating machinery. When very large pipe is involved, the spider definition is not satisfactory and there is usually no rotary table to contain a slip bowl. A large slip bowl is provided by an inner surface of a large ring and a slip chain is made up of hingedly connected individual slips. The slip chain may be handled by many men or rig hoists. The apparatus herein disclosed can be considered to be that required, in conjunction with slips and the slip bowl, to comprise a spider.

SUMMARY OF INVENTION

It is an object of this invention to provide a slip manipulator apparatus that will cooperate with a large string slip and slip bowl combination to embody the essentials of a fully operational spider.

It is another object to provide apparatus to manipulate the slips associated with a slip bowl that can be removed from the site without compromising the ability of the slip and bowl combination to support pipe and accommodate pipe handling procedures.

A powered slip lifter comprises a base and overarm hinged together on one side and provided with power means to raise the overarm relative to the base. The base rests on the rig floor, generally astride the slip bowl and the overarm is attached to the slip chain on diametrically apposite sides of the chain if it is wrapped about the periphery of a tubular in the slip bowl. Flexible links are used in attaching the overarm to the slip chain.

Travel limits of the overarm allow the flexible links to go slack when the slips are gripping pipe and are mostly inside the slip bowl. At the opposite travel limit of the overarm, the slip chain is above the slip bowl and subject to horizontal movement, clear of the slip bowl.

At least three positive movement stops are needed for controlling movement of the overarm. A first stop, during upward travel, is arranged such that the lower end of the individual slip remains withing the slip bowl. That position releases the tubular to allow vertical movement but leaves the slip chain in position to be confined by the slip bowl. The overarm can be lowered to again grip the tubular without need for human exercise directed to slip chain control. A second stop supports the overarm after it has lifted the slip chain clear of the slip bowl. A third stop positions the overarm such that the lift links will be slack when the slip chain is at rest atop the plane surface that surrounds the slip bowl.

The slip chain is usually under manual control when it is lifted clear of the slip bowl. The manual control is achieved by grasping handling loops on each end of the slip chain and spreading the ends of the chain and to control tilting of the chain as it is first lifted clear of the slip bowl, then lowered to rest the chain on the peripheral support surface. The slip chain wraps most of the periphery of the tubular but the ends are not connected together.

The flexible links between overarm and slip chain are positioned such that the lifted slip chain is about balanced. The slip chain has vertical hinge links between slips and the chain is rigid in terms of slips sagging vertically relative to the flexible links.

The base is configured to rest on a horizontal surface generally astride the slip bowl. It usually rests on the same surface plane that supports the slip bowl.

The latch that limits upward travel of the overarm is situated for manual release from each stop. It is biased to engage the stops.

The related industries have operated for years without power operated spiders for handling large tubulars. Many slip bowls already exist and, excepting the absence of power, they are very capable apparatus. There is a need for powered slip operating apparatus that can be used with the older manual slip bowls. Operating in conjunction with existing slip bowls has been considered in drafting claims for the powered slip handling apparatus.

Slips have some form of lifting linkage and provisions for attaching handles, clevises, and the like are on the existing slips. The ususal spider used with large tubulars is little more than a ring with a tapered bore to set the slips against pipe. The apparatus of this invention has a base that can straddle the slip bowl to place load bearing pads or feet on the opposite side of the center of the slip bowl relative to the pivot point between base and overarm. The overarm provides a yoke that can place lifting pad eyes in position to balance the slip chain if it is lifted by two attachment points.

The overarm is lifted relative to the base by fluid powered cylinders, or equivalent air bag. The fluid delivered to power the apparatus can be controlled remotely to generally conform to existing rig apparatus and safety guidelines.

These and other objects, advantages, and features of this invention will be apparent to those skilled in the art from a consideration of this specification, including the attached claims and appended drawings.

DETAILED DESCRIPTION OF DRAWINGS

Figure 1:
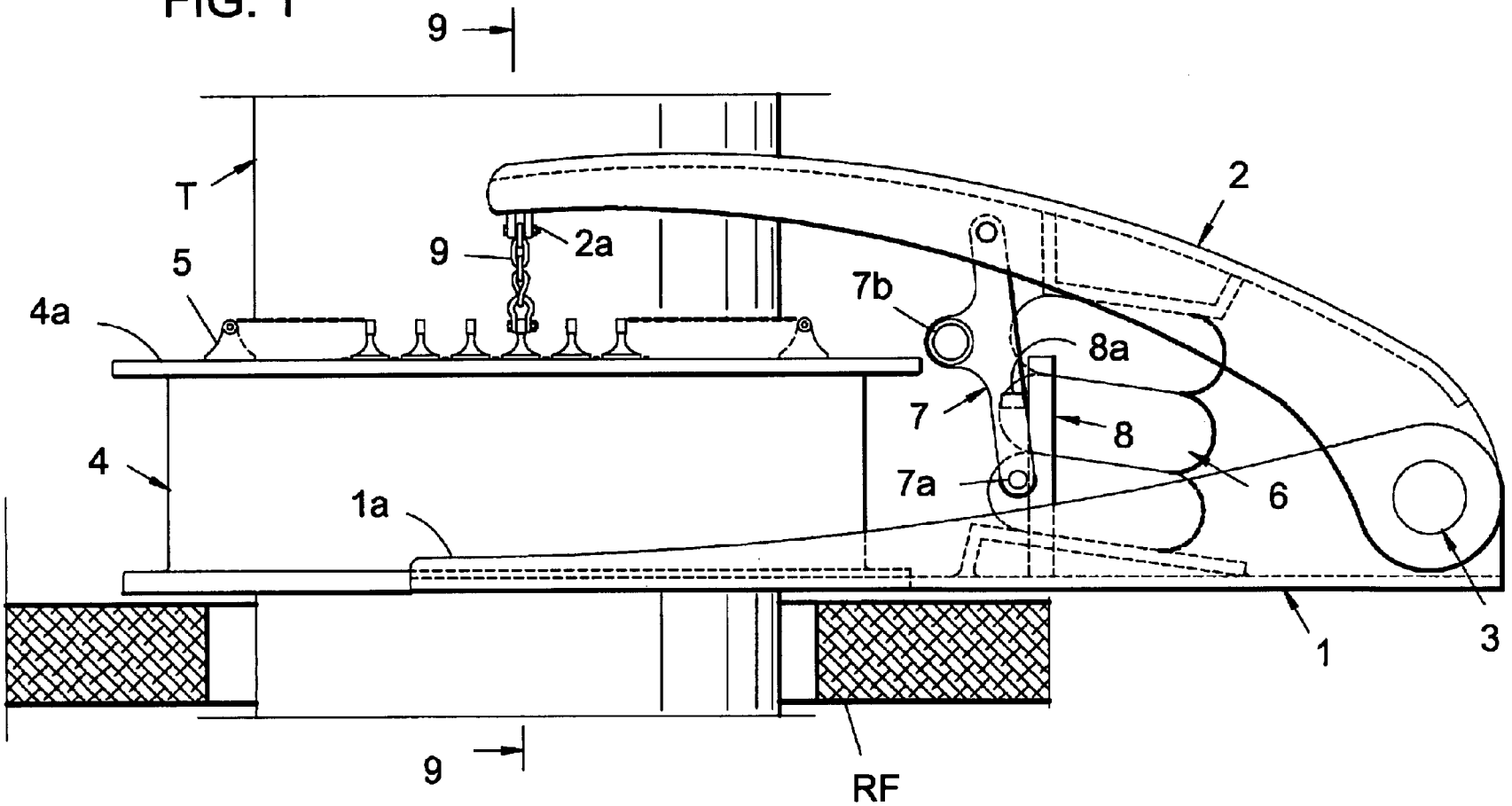
FIG. 1 is a side view of the preferred embodiment in the position to support a pipe string.

In the drawings, like captions refer to the same features. The drawings are formal but some features that do not bear upon points of novelty are omitted in the interest of clarity. Such omissions may include weld lines, fasteners, and the like.

FIG. 1 shows the apparatus in the working situation, and in the slips down position. Base 1 is secured to overarm 2 by pivot hinge 3. The base straddles the slip bowl 4 to place extensions 1 a alongside the slip bowl.

Overarm 2 straddles the tubular T and has attachment points 2*a* on each side. From the points 2*a* (one shown) a flexible link 9 extends to an attachment point on the slip chain 5. The attachment points on the slip chain are such as to about balance the slip chain when it is lifted clear of the slip bowl.

Figure 2:
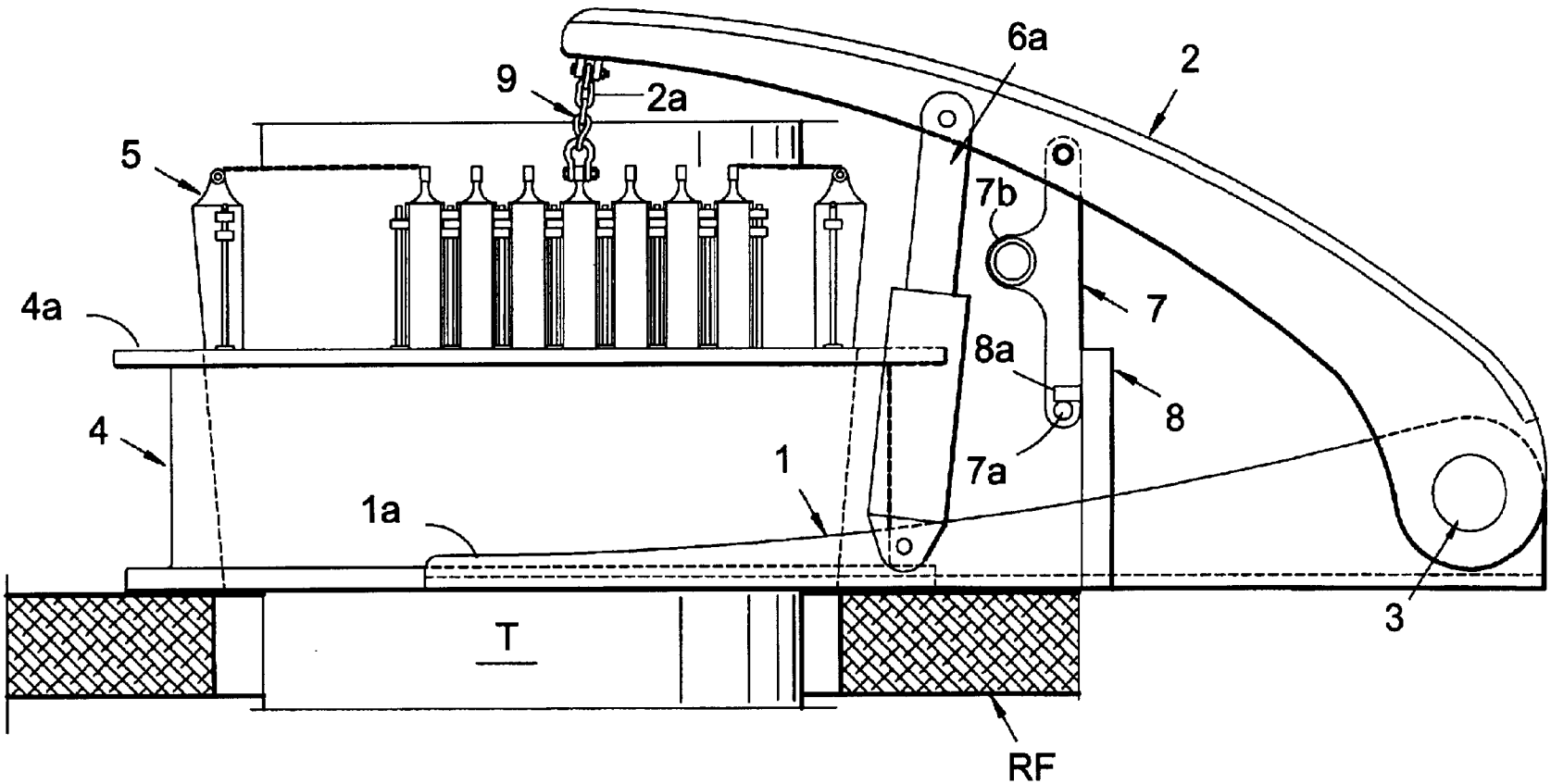
FIG. 2 is a side view, similar to FIG. 1 but in a second position.

The overarm 2 is raised by a thruster 6, shown as an air bag, or by equivalent fluid powered cylinders 6*a* as shown in FIG. 2. The amount of travel of the overarm is such that the slips can be full down as shown with the links 9 slightly slack. The upper limit of travel of the overarm is enough to lift the slips clear of the slip bowl. Both slip bowl 4 and base 1 rest independently on rig floor RF.

latch link: 7 pivotably attached to the overarm is positioned to engage latch pin 8*a* and latch bar 7*a*. Latch pin 8*a* is on latch post 8 which is attached to the base. No latch positions engaged in FIG. 1. Synchronizing bar 7*b* connects latch bars 7 on opposite sides of the overarm.

Figure 3:
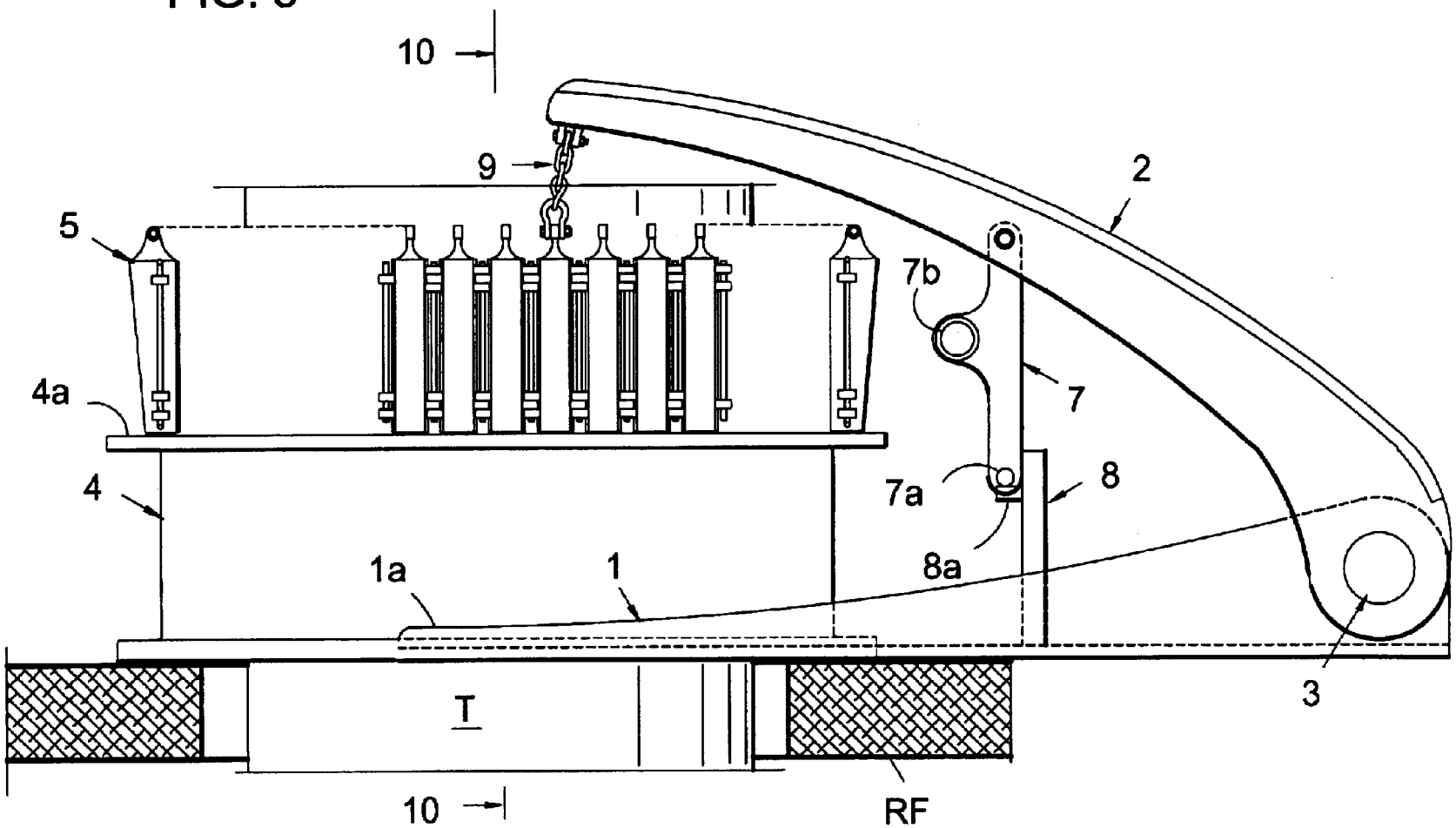
FIG. 3 is a side view, similar to FIG. 1 but in a third position.

In FIG. 2 the thruster 6 is omitted and replaced by two fluid power cylinders 6*a*, the near side one shown The slips 5 have been lifted to release the tubular T but stopped with the lower ends of the slips in the slip bowl. If the overarm 2 is lowered from this position the slips 5 will set to support the tubular. The latch pin 8*a* is in position to engage bar 7*a*. Link 7 is wet biased to push link 7 against the mast 8. Bar 7*a* and latch pin 8*a* are engaged to place the slip chain in the controlled position shown FIG. 3 shows the slip chain 5 resting on the horizontal plane of the peripheral surface 4*a* of the slip bowl 4. The slip chain was first lifted somewhat higher, allowing latch bar 7*a* to slip over the top of latch pin 8*a*. The overarm was then lowered to position the slip chain on surface 4*a* and provide some slack in link 9.

Figure 4:
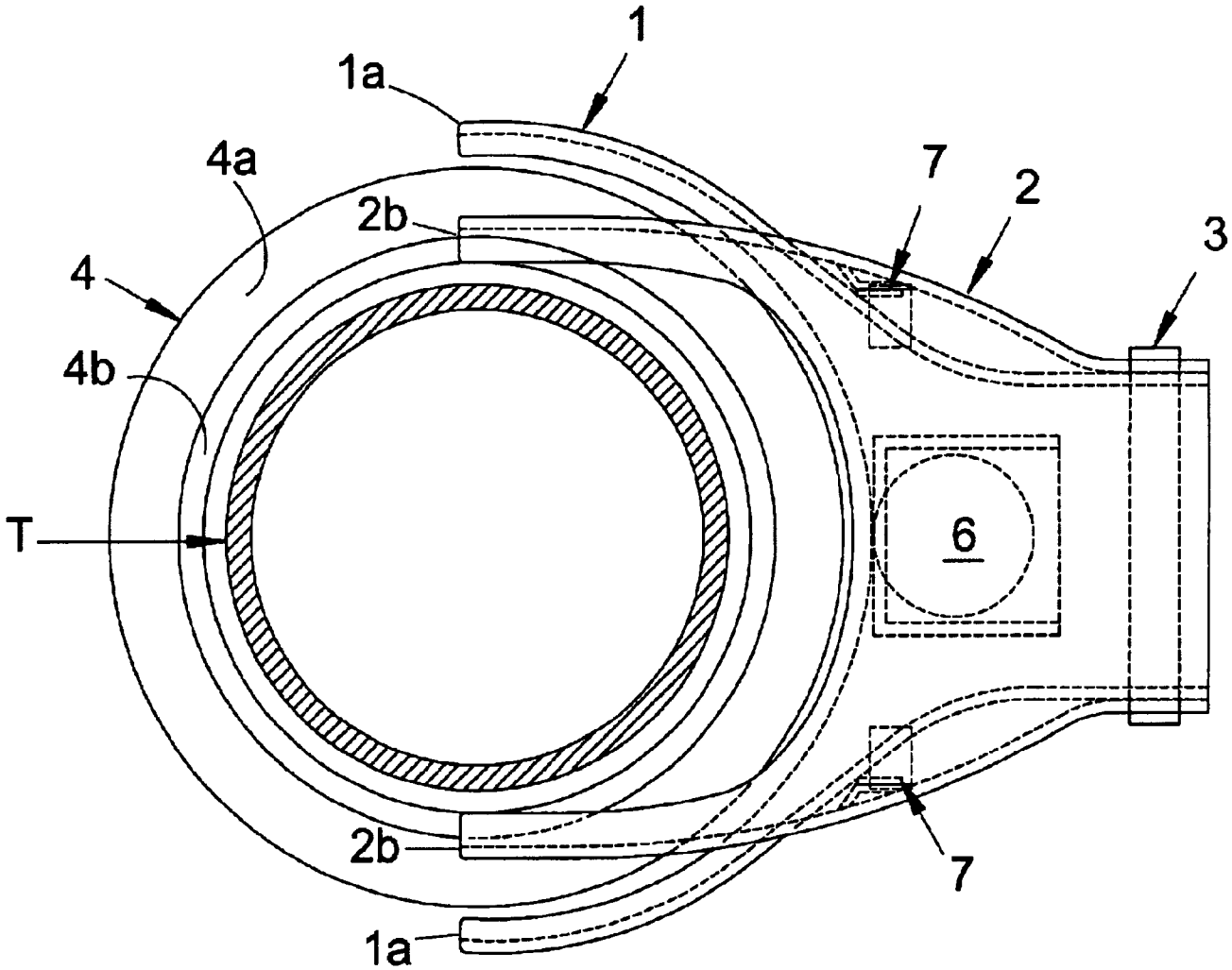
FIG. 4 is a top view of the apparatus of FIG. 1, 2, and 3.

FIG. 4 provides a top view of the overarm 2 and the base 1. They are similarly shaped but the base extensions 1*a* must straddle the slip bowl and the overarm can be narrower to straddle the tubular with arms 2*b*. The latch 7 is dashed on both sides. It would not be used on both sides unless interconnected. The latch will very likely be arrange with remote controls and the may be intrinsic. Links 7 can be connected by a tube synchronizing 7*b* (FIG. 3) rigidly attached to the two links. Movement of one link would then move both links.

The preferred positioning of thruster 6 is about the equivalent to one fluid power cylinder on each side. Cylinders, if used, are not shown but would be positioned near the positions of latches 7 as shown in FIG. 2.

Figure 6:
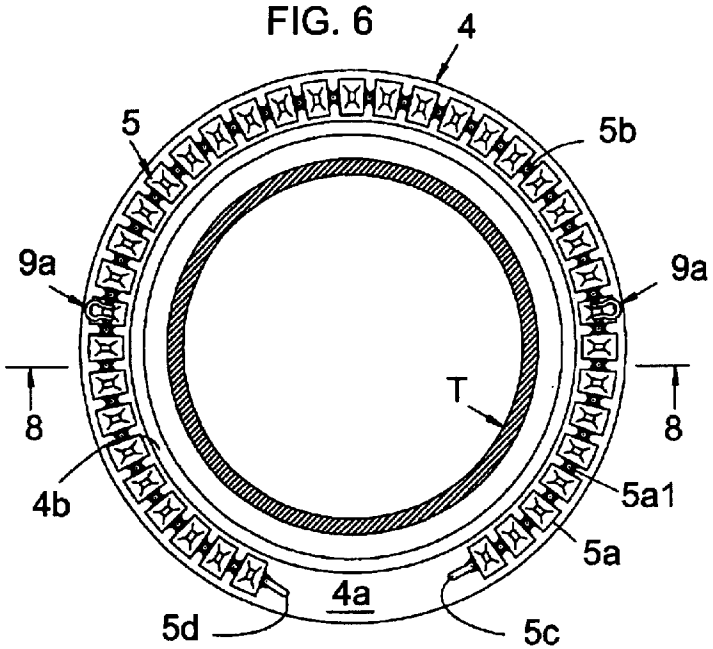
FIG. 6 is atop view identical with FIG. 5 but with the slip chain, spread and resting on the upper plane of the slip bowl.
Figure 5:
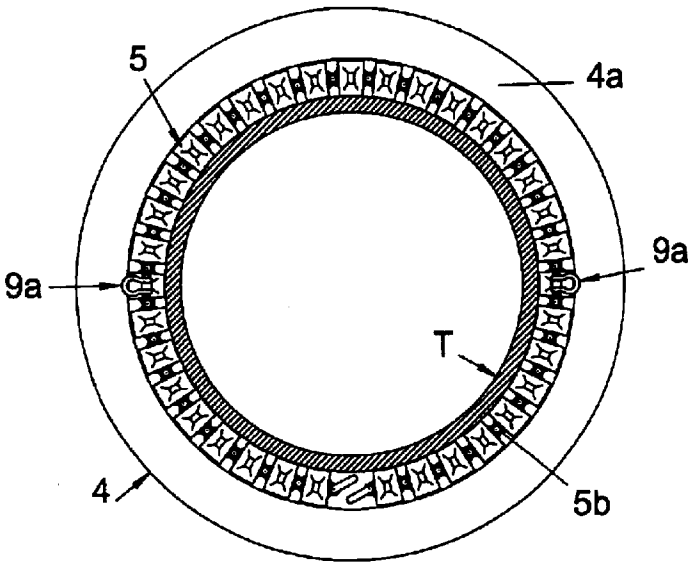
FIG. 5 is a top view of the slip bowl and slip chain positioned to support tubulars.
Figure 7:
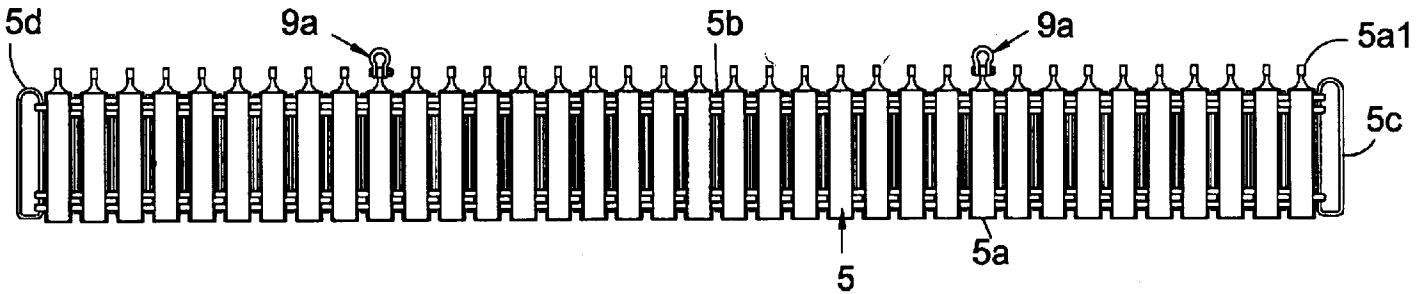
FIG. 7 is a side view of the slip chain spread out straight.

FIG. 5, 6, and 7 show the convenient attachment points, on the slip chain, for clevis units 9*a* Clevis units 9*a* are the lower terminals of the flex ink 9 of FIG. 1. Slip chain 5 comprises individual slips 5*a* with it clevis fitting top S*a*1, joining is rods 5*b*, end handles 5*c* and 5*d* and hanger clevises 9*a*. The slip chain fits between the slip bowl surface 4*b* and the supported tubular T, resting against the tapered bowl surface 4*b* to wedge the tube T in vertical position on. When the slip chain is lifted, it can be spread slightly to rest on surface 4*a*.

Figure 8:
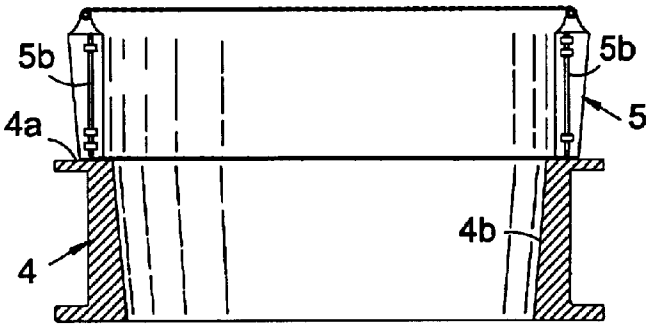
FIG. 8 is a sectional view taken along line 8—8 of FIG. 6.

FIG. 8 shows a section of a slip bowl and slip chain cut along line 8—8 of FIG. 6. The slip chain rests atop the plane surface 4*a* where it is stable and allows pipe, and stabilizers, to move free along the slip bowl centerline.

Figure 9:
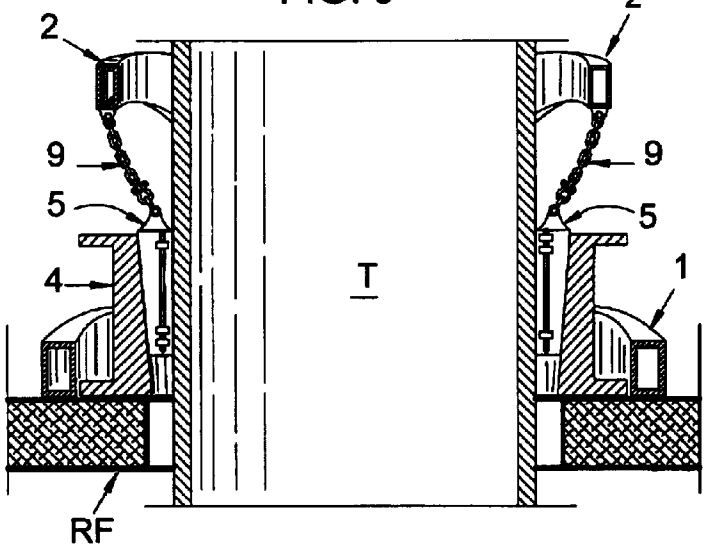
FIG. 9 is a sectional view taken along line 9—9 of FIG. 1.

FIG. 9, from the same aspect as FIG. 8, shows the manipulator in place (also sectioned) to operate the slip. Slips 5 are not supported by slack chains 9. The overarm 2 has been lowered so that the chains do not interfere with the setting of the slips. The slip bowl 4 and the manipulator base 1 can rest on the same surface, rig floor RF in this case.

For installing very large pipe the rotary table, if present, is removed. The rig floor RF is shown bare with a simple hole therethrough. Such regions vary greatly from rig to rig and simplicity in the drawing is not to be construed as a limitation.

Figure 10:
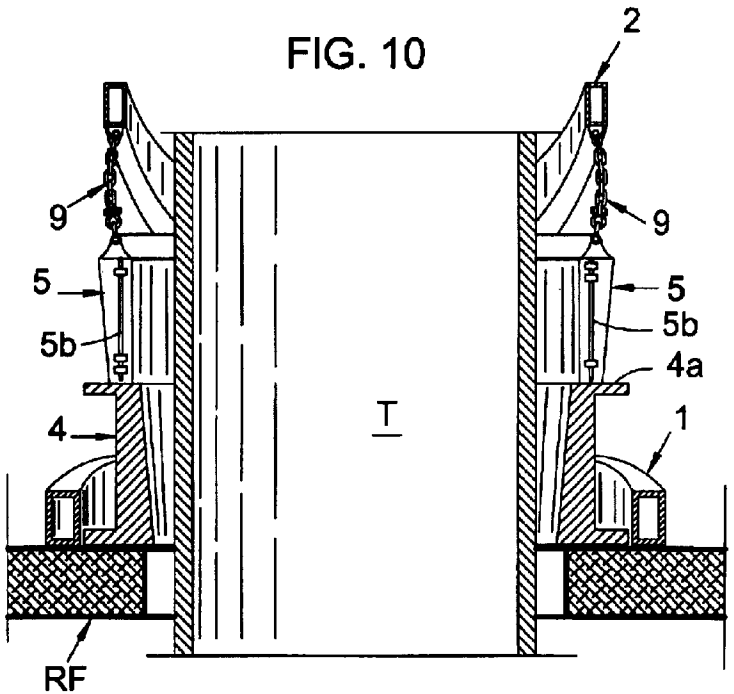
FIG. 10 is identical to FIG. 9 except that the slip are lifted.

FIG. 10, the same arrangement as in FIG. 9, taken along line 10—10 of FIG. 3, shows the slip chain 5 lifted clear of the slip bowl and set down stop the plane surface 4*a*. Referred to the related FIG. 3, the latch 7 has stopped the downward movement of the overarm to allow the slip chain to rest atop surface 4*a*.

From the foregoing, it will be seen that this invention is one well adapted to attain all of the ends and objects hereinabove set forth, together with other advantages which are obvious and which are inherent to the invention.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

We claim:

1. A slip manipulating apparatus for use on earth borehole related work using pipe strings suspended from slip equipped slip bowls at the earth surface, the apparatus comprising:

a) a single bifurcated base situated on one side of the borehole and arranged to straddle a slip bowl and provide support means for an overarm;

b) said overarm arranged to straddle a pipe string extending upwardly through a spider, and to move vertically relative to said base;

c) force means, arranged to extend and contract in response to controls, situated to cause said overarm to said move vertically relative to said base; and d) suspension means on the overarm for attachment, for lifting, of a slip assembly;

e) the slip bowl, independent of said bifurcated base, disposed about the extended axis of said borehole; and f) the slip assembly comprising hingedly interconnected slip, the assembly having two ends, situated in said slip bowl and suspended by flexible links to said overarm.

2. The slip manipulating apparatus of claim 1 wherein said force means comprises at least one air bag situated to raise and lower said overarm in response to manipulated pressure.

3. The slip manipulating apparatus of claim 1 wherein said force means comprises at least one fluid powered cylinder situated to raise and lower said overarm in response to manipulated pressure.

4. The slip manipulating apparatus of claim 1 wherein said bifurcated base and said overarm are hingedly connected.

5. The slip manipulating apparatus of claim 1 wherein said overarm has latch means to controllably regulate elevation of said overarm.

6. The slip manipulating apparatus of claim 5 wherein said latch means is arranged to stop said overarm at selected heights relative to said base.

7. A pipe supporting spider apparatus for use on earth borehole related work using pipe strings suspended from a slip equipped slip bowl at the earth surface, the apparatus comprising:

a) an independent slip bowl partially extending peripherally about a central bore to accept a pipe string extending vertically therethrough b) a plurality of slips linked together to form a slip chain to cooperate with said slip bowl to support pipe when situated therein.

c) an open-sided bifurcated base, arranged to straddle said slip bowl an, laterally movable to and from said slid bowl to provide support means for an overarm;

d) said overarm arranged to straddle a pipe string extending upwardly through the slip bowl, and to move vertically relative to said base;

e) force means arranged to extend and contract in response to controls situated to cause said overarm to rise when said force means extends; and f) suspension means on said overarm for attachment to and manipulation of said plurality of slips attached thereto.

8. The pipe supporting spider apparatus of claim 7 wherein said force means comprises at least one air bag situated to raise and lower said overarm in response to manipulated pressure.

9. The pipe supporting spider apparatus of claim 7 wherein said force means comprises at least one fluid powered cylinder situated to raise and lower said overarm in response to manipulated pressure.

10. The pipe supporting spider apparatus of claim 7 wherein said bifurcated base and said overarm are connected by pivoting means with a generally horizontal axis.

11. The pipe supporting spider apparatus of claim 7 wherein said overarm has manually movable latch means to controllably regulate elevation of said overarm.

12. The slip manipulating apparatus of claim 11 wherein said latch means is arranged to stop said overarm at selected heights relative to said base.

* * * * *